United States Patent [19]

Killinger

[11] 4,275,675

[45] Jun. 30, 1981

[54] BOBBIN CASE WITH THREAD GUIDE FOR CYCLIC SEWING MACHINE

[75] Inventor: Karl H. Killinger, Dover, N.J.

[73] Assignee: The Singer Company, Stamford, Conn.

[21] Appl. No.: 81,405

[22] Filed: Oct. 3, 1979

[51] Int. Cl.[3] ..... D05B 57/26

[52] U.S. Cl. ..... 112/229; 112/231

[58] Field of Search ..... 112/228, 229, 230, 231, 112/302

[56] References Cited

U.S. PATENT DOCUMENTS

| | | | |
|---|---|---|---|
| 944,740 | 12/1909 | Madison | 112/231 X |
| 1,146,406 | 7/1915 | Diehl et al. | 112/228 |
| 2,694,373 | 11/1954 | Covert et al. | 112/228 X |
| 3,486,473 | 12/1969 | Ross | 112/229 |
| 3,762,350 | 10/1973 | Starnes | 112/231 |

FOREIGN PATENT DOCUMENTS

| | | | |
|---|---|---|---|
| 761437 | 2/1952 | Austria | 112/231 |
| 1341762 | 9/1963 | France | 112/228 |

*Primary Examiner*—Wm. Carter Reynolds

*Attorney, Agent, or Firm*—Edward L. Bell; Robert E. Smith

[57] ABSTRACT

A bobbin case for use in machines having underbed thread trimmers incorporates a thread guide consisting of a piano wire soldered to the cylindrical skirt of the case in the region between the leaf tension spring and the point at which the thread is cut by the trimming blade. A groove is formed under and partly through the wire and also partly through the cylindrical skirt. The groove is directed at an angle to the longitudinal direction of the skirt such as to place the groove in line with the direction of movement of the thread to facilitate smooth thread handling.

5 Claims, 6 Drawing Figures

Fig. 3.
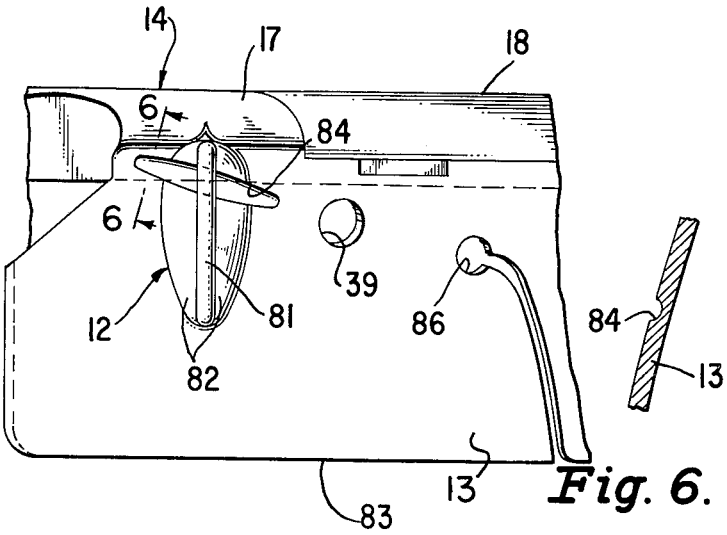
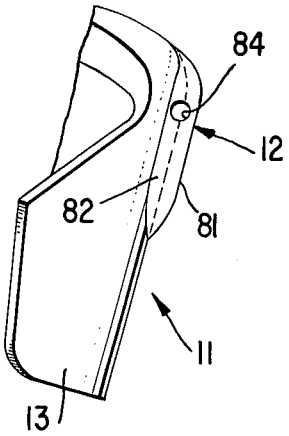
Fig. 5.
Fig. 6.
Fig. 4.
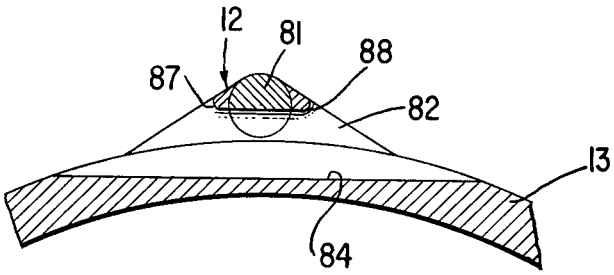

BOBBIN CASE WITH THREAD GUIDE FOR CYCLIC SEWING MACHINE

BACKGROUND OF THE INVENTION

Cyclic sewing machines for industrial use, such as those used to make bar tacks, buttonholes, and other stitch formations that are followed by cutting the thread by means of an underbed thread trimmer must be arranged so that the end of the bobbin thread is long enough to be engaged by the needle thread in the formation of the next set of stitches. In addition, the end of the bobbin thread must be in the right position for this to happen.

In some bobbin cases, the thread emerges from the cylindrical side of the case underneath the leaf spring that closely follows the curvature of the cylindrical side. At the end of the leaf spring, the thread is free of further constraints. When a bobbin case of that type is used in a cyclic sewing machine, or at least a sewing machine that has an underbed thread trimmer, the cutting mechanism that severs the thread does so at a location approximately an inch or so away from the point at which the thread emerges from under the leaf spring. The severed end of the bobbin thread at the location of the cutting knife or knives is both axially and angularly displaced from the point of emergence of the thread from under the leaf spring, and it is possible for the short length of thread between the leaf spring and the severed end to droop between the time the thread is severed and the time the material to be sewen is repositioned to make the next set of stitches. If the end of the thread is long enough it occasionally droops far enough to extend into the path of rotation of the rotary hook in which the bobbin case is located, and when that happens, the end of the thread may be pulled part of the way around the circumference of the bobbin case between the cylindrical portion of the case and the inner wall of the hook. In that event, the bobbin thread will not engage the needle thread, and no stitches can be formd until the operator opens up the mechanism to retrieve the end of the bobbin thread and place it in a proper position to be caught by the needle thread.

A number of forms of bobbin cases have been made heretofore with integral or attached means to hold the thread at a point beyond the end of the leaf spring so that the free end of the bobbin thread will be closer to the proper position to be engaged by the needle thread in forming the next set of stitches. In some instances, such as in U.S. Pat. No. 2,694,373, an additional bracket has been attached by means of a small screw to provide a channel for the bobbin thread. In other types of bobbin cases, a curled pigtail of wire has been soldered to the bobbin case to form an eye through which the bobbin thread is led. In further types of bobbin cases, such as in U.S. Pat. No. 3,486,473, a machined element has been added to the wall of the case to form a tunnel through which the thread can be inserted. As an alternative to providing guide means on the bobbin cases, it has been proposed previously to form grooves along the surface of bobbin case baskets as in U.S. Pat. No. 3,074,367 or to form tunnels through bobbin case baskets as in U.S. Pat. No. 944,740 or to provide a slot closed by spring thread retaining means as in U.S. Pat. No. 1,197,611.

All of the foregoing bobbin cases and baskets are complex to construct and do not place the channel through which the thread must extend directly in line between the point of emergence of the thread from under the leaf spring and the point of engagement between the bobbin thread and the needle thread.

SUMMARY OF THE INVENTION

It is one of the objects of the present invention to provide a simple thread guide for a bobbin case and to arrange the thread guide in such a way that it is properly in alignment with the location of the point of emergence of the bobbin thread from under the leaf spring and the point at which the bobbin thread and needle thread are joined together in creating stitches.

In accordance with the present invention, a short piece of wire, such as piano wire, is soldered to a specific point along the cylindrical surface of a bobbin case adjacent the usual cut out segment aligned with the point of entry of the needle into the bobbin case during stitch formation. A passageway is formed between the cylindrical skirt of the bobbin case and the wire. The passageway is rounded, not only in its cross section, but along its outer edges to allow for smooth thread handling. Preferably, the passageway should not be cylindrical, even for the short distance under the wire, but should be slightly enlarged at the ends of the passageway relative to the cross sectional dimension of the passageway at its center.

A thread guide of the type just described provides, when located as stated, a support for the short length of thread remaining outside of the bobbin after the thread has been cut by an underbed thread trimmer. The location of the thread trimmer is dependent on other features and would be the same whether or not there was a thread guide on the bobbin case. However, a guide of the type described, allows the thread to move smoothly to the region in which the stitches are formed, and the free end of the thread after the severing operation is so short that it is relatively stiff and self-supporting. This prevents the thread from drooping to such a degree that the end might be engaged by the beak of the rotary hook and improperly wrapped around the bobbin case.

BRIEF DESCRIPTION OF THE DRAWINGS

FIG. 3 is an enlarged, fragmentary view of a part of the bobbin case in FIG. 1, showing particularly the thread guide according to the present invention;

FIG. 4 is a fragmentary rear view of the bobbin case in FIG. 1 showing the part on which the thread guide is located in accordance with the present invention;

FIG. 5 is a fragmentary side view of the bobbin case in FIG. 1 showing the thread guide in greater detail;

FIG. 6 is a fragmentary cross sectional view of a portion of the skirt of the bobbin case in FIG. 1 illustrating the cross section of the skirt in the center of the thread guide passageway.

DETAILED DESCRIPTION OF THE PREFERRED EMBODIMENT

Figure 1:
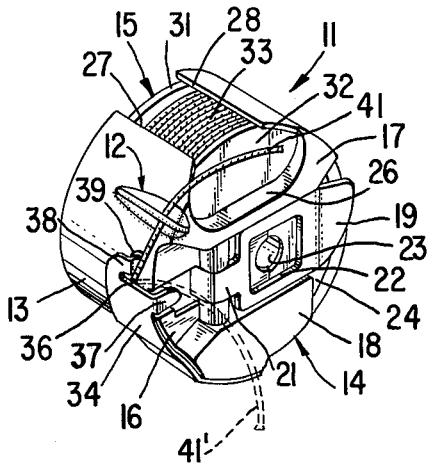
FIG. 1 is a perspective view of a bobbin case according to the present invention.

FIG. 1 shows a bobbin case 11 that includes a thread guie 12 according to the present invention. The bobbin case, itself, includes a cylindrical skirt 13 and a substantially closed outer end that forms a front wall 14 at one end of the skirt. This end is arbitrarily defined as being the front end simply because it is the end most directly available to a sewing machine operator upon opening that part of the sewing machine to replace or adjust the bobbin 15 which, in normal use, is enclosed within the bobbin case 11. The central part 16 of the front wall 14 is recessed between two thicker portions 17 and 18, and a lower plate 19 fits into the recessed portion 16 and is supported at one end by a hinge 21. The lever plate is of a standard type and has an aperture 22 aligned with another aperture 23 in a sliding latch plate 24.

Figure 2:
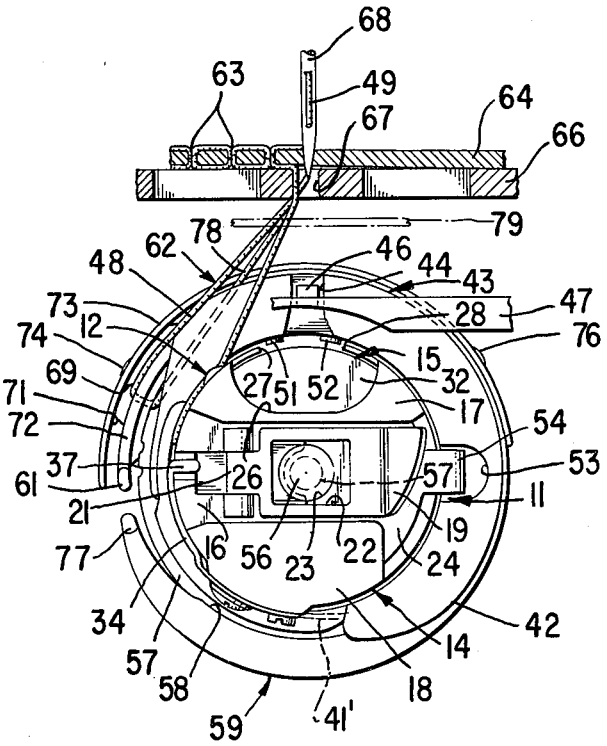
FIG. 2 is a plan view of the bobbin case in FIG. 1 and a basket surrounded by a rotary hook.

The upper portion 17 of the front wall 14 has a cut-out section 26 that extends into the adjoining part of the skirt 13 to provide ample room for the sewing machine needle when the bobbin case 11 is in use, as will be described later in connection with FIG. 2. The edges 27 and 28 of the cut-out section 26 and the skirt 13 also help guide the bobbin case 11 properly into position when the case is inserted into a hook. The bobbin 15, as may be seen through the cut-out section 26, has two flanges 31 and 32. The bobbin also has a hollow central axle, as is customary, but the axle is not visible in FIG. 1. A quantity of thread 33 is wound on the hollow central axle in the space bounded by the axle and the inner surfaces of the two flanges 31 and 32.

The skirt 13 has a standard slot, which is not shown in FIG. 1, through which an end of the bobbin thread 33 is guided when the bobbin is inserted into the case 11. This slot terminates under a leaf spring 34 that is attached to the skirt 13 by means of screws not visible in FIG. 1. The leaf spring is shaped to conform to the part of the skirt 13 with which it is in contact, and at its free end 36, it has two fingers 37 and 38. The finger 37 is bent over the edge at which the skirt meets the recessed part 16 of the front wall 14. The finger 36 is bent only slightly to extend into a hole 39 in the skirt 13.

An end 41 of the bobbin thread 33 extends out from under the end 36 of the leaf spring 34 and is prevented by the fingers 37 and 38 from shifting away from the end 36. The end portion 41 is threaded through the guide 12 and extends up into the vicinity of the cutout section 26.

The bobbin case 11 in FIG. 1 fits into a bobbin case basket 42 that has a radial flange 43 with a retainer notch 44. A lug 46 extending from a bobbin case retainer bar 47 engages the notch 44 well enough to prevent the bobbin case basket 42 from rotating but loosely enough so that one limb 48 of a loop of needle thread 49 can slip between the lug 46 and the walls that define the retainer notch 44 in operation of the sewing machine. The basket includes two projections 51 and 52 that guide the entry of the bobbin case 11 into a recess in the basket 42 by determining the location of the edges 27 and 28 of the cut-out section 26. In addition, the radial flange 43 includes a notch 53 that receives a latch 54 at one end of the latch plate 24. The basket 42 has a central pin 56 with a notch 57 near its outer end to be engaged by an edge of the aperture 23 in the latch plate 24 so as to hold the bobbin case 11 in the proper axial position with respect to the bobbin case basket 42.

The bobbin case basket has a rail 57 that fits into a raceway 58 of a rotary hook 59 to allow the hook to rotate freely on the bobbin case basket 42. The rotary hook 59 has a beak 61 that picks up a loop 62 of the needle thread 49 as one of the steps of the formation of a series of stitches 63 in a work piece 64. The work piece is moved along the upper surface of a throat plate 66 that has an aperture 67 aligned with a reciprocally movable sewing machine needle 68. The limb 48 of the needle thread loop 62 is shown shortly after it has been picked up by the hook beak 61 and has been pulled far enough to engage a V-shaped crotch 69 at the end of a throat 71 between the lip portion 72 of the hook beak 61 and a concentric guide plate 73. The latter is attached to the hook 59 by screws 74 and 76. The hook beak 61 is angularly spaced a short distance from a thread guiding projection 77. The gap between the hook beak 61 and the thread guiding projection 77 forms a space through which the needle thread loops 62 can pass at appropriate times during the formation of the stitches 63. The limb 48 of the loop 62 extends from the last-formed one of the stitches 63. The other limb 78 of the loop 62 extends from the needle 68.

Between the hook 59 and the throat plate 66 is shown, in phantom, a cutting blade for an underbed thread trimmer. Complete structures for performing such trimming are shown in Ross U.S. Pat. No. 3,386,402 and in my U.S. Pat. No. 3,895,591. The trimming apparatus, itself, is not part of the present invention and need not be described in detail here. It is sufficient to say that, at the end of a set of stitches, such as the formation of a bar tack, the mechanism 79 cuts the bobbin thread 33 and the thread 48 that forms the loop 62. In cutting the bobbin thread 33, a sufficient length must be left at the end 41 (FIG. 1) to allow this end to be engaged by the needle thread 49 at the start of the formation of the next set of stitches.

FIG. 1 shows, in phantom, an alternative location for an end 41' of the bobbin thread, if the bobbin case 11 had no thread guide 12. The free end 41' would then be supported only by its own stiffness over its entire length from the point at which it emerges from under the tension spring 34 to the outermost tip. Under such circumstances, some threads will tend to droop sufficiently so that the end 41' could be engaged by the rotation of the hook 59 in FIG. 2, not in the manner to cause proper interlocking of the bobbin thread 33 with the loop 62 of the needle thread 49, but in such a way as to drag the end 41' circumferentially around the bobbin case 11, as shown in phantom in FIG. 2. This places the end 41' in the small space between the bobbin case 11 and the basket 42, in which location the thread end 41' cannot be engaged by the loop 62 of needle thread. As a result, it is necessary for the operator to extract the thread end 41' from that inaccessible location and bring it out where it can be caught by the next loop 62. Any such interference with the steady progression of stitching in an industrial sewing machine is undesirable, either as a source of lost time, which equates to lost money, or as a source of imperfect sewing, which will, at the very least, be a source of annoyance to the purchaser of the supposedly sewn product.

By providing the bobbin case 11 with a thread guide 12, a part of the end portion 41 (FIG. 1) of the bobbin thread 33 will be supported, which means that the unsupported portion is shorter than it would be without the thread guide and thus inherently stiffer. This would prevent the end from drooping as readily and would keep it in the proper region to be engaged by the loop 62 at the beginning of the next set of stitches. In addition, the length of the unsupported end portion 41 would not be sufficient to allow it to be caught by the hook beak 61, no matter how limply the thread was able to droop. As a result, it would be impossible for the end 41 to engage the hook beak 61 and be drawn into an improper location.

Industrial sewing machines of the type likely to incorporate underded thread trimming apparatus frequently are required to operate at very high rates of speed. This places a particular emphasis on smooth thread handling, including handling of the bobbin thread from the bobbin on through the space between the skirt 13 and the end of the tension spring 34 and the thread guide 12 to the point where the thread end 41 engages the loop 62 to produce the interlocking relationship necessary to effect the stitches 63, as shown in FIG. 2. In addition to smooth thread handling, another desirable factor is that the entire structure, including the thread guide 12, be easy to manufacture and able to stand up under hard usage.

FIGS. 3–6 show the detail of the thread guide 12 of FIG. 1, which has all of the features listed as desirable. As shown in FIG. 3, the thread guide 12 includes a short, straight length of cylindrical piano wire 81 attached by means of a quantity of solder 82 to the skirt 13. The longitudinal direction of the wire 81 is parallel to the axis of the skirt 13, and the wire extends from approximately the region at which the portion 17 of the front wall 14 intersects the skirt 13 to a point about half way back along the length of the skirt from the front wall 14 to the rear edge 83.

A slot, or passageway, 84 in the outer surface of the cylindrical skirt 13 extends across the solder 82 at an angle of approximately 70 to 90 degrees with respect to the longitudinal axes of the wire 81. This slot is substantially in line with the aperture 39 in which the finger 38 extends, as shown in FIG. 1, and it is also substantially in line with the enlarged end of the slot 86 into which the bobbin thread is guided originally. The slot 86 terminates rearwardly of the front wall 14 and is visible in FIG. 3 but is covered by the spring 34 in FIG. 1. The alignment between the slot 84 and the enlarged end of the slot 86 creates as direct a path as possible from the slot 86 through the thread guide 12 and on to the region at which the thread end 41 (FIG. 1) is able to be engaged by the loop 62 of the needle thread 49. Thus, the bobbin thread is not required to go through any abrasive convolutions that would cause it to wear or to be subjected to excessive tension.

FIG. 4 shows an end view of the same part of the bobbin case 11 as is shown in FIG. 3. As may be seen, the wire 81 is in contact, or at least nearly in contact, with the skirt 13, and the solder 82 is smoothly built up on both sides of the wire 81 to hold the wire firmly in place on the skirt 13. More precisely, the wire is preferably spaced about 0.005" from the skirt. The slot 84 extends straight across a chordal section of the skirt 13 but, preferably not entirely through the wall of the skirt. Where the slot 84 passes under the wire 81, it extends part way up into the wire, and the outer edges of the slot 84 are shown as being rounded upwardly at the points 87 and 88, so that there will be no sharp edges to abrade the thread passing through the slot 84.

FIG. 5 shows a view looking directly along the slot 84, which is seen to be a rounded hole that passes partly through the skirt and partly through the wire 81, as well as through the solder 82. The slot 84 may be formed by drilling with the aid of a jig that fits around the wire and solder, or it may be formed by a milling operation along the skirt 13, followed by attachment of the wire 81 to the skirt by means of the solder 82. Such attachment would then be followed by further abrasive action, such as by running an emery thread along the milled slot and under the wire 81 to open up the slot 84 to a diameter of about 0.025 inch, which is slightly less than the 0.026 diameter of the wire 81. If the slot 84 is first milled into the wall of the skirt 13, as indicated in FIG. 6, it is milled to a maximum depth of approximately 0.013 inch, which is approximately half the thickness of the skirt 13. The width of the milled slot at its maximum would be about 0.025 inch.

The resulting structure, however the slot 84 is formed, is completely deburred, and all excess solder is removed to prevent any possible interference with the passage of thread through the thread guide 12.

While the thread guide of the present invention has been defined in terms of specific dimensions, it will be understood by those skilled in the art that such dimensions are only illustrative and that the true scope of the invention is defined by the following claims.

I claim:

1. A bobbin case comprising:

a front wall;

a generally cylindrical skirt extending rearwardly from the front wall;

a leaf spring shaped to conform to a limited part of the cylindrical skirt;

a slot extending along the cylindrical skirt from the rear edge thereof towards the front wall and terminating at a location covered by the leaf spring, the slot being wide enough to allow thread to be guided along the slot and under the leaf spring, with a free end of the thread extending from under an edge of the leaf spring;

a needle opening through the cylindrical skirt at a location angularly displaced from the edge of the leaf spring where the thread emerges;

guide means comprising a length of wire shorter than the axial length of the cylindrical skirt and soldered to the exterior surface of the skirt and extending generally parallel to the axis of the cylindrical skirt in a region between the end of the leaf spring and the location of the needle opening; and a passageway partly formed in the cylindrical skirt under the wire and partly formed in the wire on the side thereof facing the cylindrical skirt to allow the thread emanating from under the leaf spring to be guided through the passageway under the wire to be supported by the wire so as to prevent the end of the thread from drooping to a location in the path of rotation of a rotary hook in which the bobbin case is supported.

2. The invention as defined in claim 1 in which the location in which the slot terminates in the cylindrical skirt is displaced rearwardly from the front wall, and the passageway formed in the cylindrical skirt extends along the cylindrical skirt in a direction aligned with the location at which the slot terminates.

3. The invention as defined in claim 2 in which the passageway extends at an angle of between about 70° and 90° with respect to the axial direction of the cylindrical skirt.

4. The invention as defined in claim 1 in which the wire is cylindrical and straight, and the passage way is smoothly contoured at all points along it, including the region in which the passageway intersects the wire.

5. The invention as defined in claim 1 in which the diameter of the wire is approximately 0.026", the wire is soldered to the exterior surface of the skirt to be spaced approximately 0.005" from the skirt, and the passage way has a diameter of approximately 0.025" and extends approximately 0.013" deep into the surface of the skirt immediately beneath the wire.

* * * * *